US006471124B1

(12) United States Patent
Tedeschi, Jr.

(10) Patent No.: US 6,471,124 B1
(45) Date of Patent: Oct. 29, 2002

(54) CONTAINER WITH INTEGRAL SPACER

(75) Inventor: Thomas Tedeschi, Jr., Brewster, NY (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/853,638

(22) Filed: May 14, 2001

(51) Int. Cl.[7] ..... B65D 5/20
(52) U.S. Cl. ..... 229/179; 229/178; 229/191
(58) Field of Search ..... 229/178, 179, 229/190, 191

(56) References Cited

U.S. PATENT DOCUMENTS

| | | | | | |
|---|---|---|---|---|---|
| 471,400 | A | * | 3/1892 | Scott | 229/179 |
| 2,357,155 | A | * | 8/1944 | Williams et al. | 229/179 |
| 2,731,191 | A | * | 1/1956 | Layne | 229/178 |
| 3,310,219 | A | * | 3/1967 | Dlugopolski | 229/178 |
| 3,883,067 | A | * | 5/1975 | McGlynn et al. | 229/179 |
| 4,056,223 | A | * | 11/1977 | Williams | 229/190 |
| 4,676,429 | A | * | 6/1987 | Crowe et al. | 229/179 |
| 5,996,885 | A | * | 12/1999 | Chu | 229/191 |
| 6,092,716 | A | | 7/2000 | Smith | 229/117.04 |
| 6,098,873 | A | | 8/2000 | Sheffer | 229/178 |
| 6,158,652 | A | | 12/2000 | Ruiz et al. | 229/178 |

FOREIGN PATENT DOCUMENTS

| | | | | |
|---|---|---|---|---|
| EP | 455310 | A | * 11/1991 | 229/190 |

* cited by examiner

*Primary Examiner*—Gary E. Elkins
(74) *Attorney, Agent, or Firm*—Larson & Taylor, PLC

(57) ABSTRACT

A container is formed from a plurality of panels that are folded to form two opposing sidewall panels and a bottom panel. An integral spacer is formed from flaps foldably joined to sidewall panels. The integral spacer provides a reduced inside length dimension relative to its corresponding outside length dimension.

13 Claims, 3 Drawing Sheets

CONTAINER WITH INTEGRAL SPACER

FIELD OF THE INVENTION

The present invention relates to a container, and in particular, to a container with a reduced inside length dimension relative to its outside length dimension.

BACKGROUND OF THE INVENTION

Containers formed from paperboard or corrugated cardboard are generally formed from a one piece flat blank. The blank generally has a plurality of panels that are folded such that a container may be manufactured in a collapsed, flat configuration and then erected into a linear rectilinear box or erect condition.

The dimensions of the container are defined by the various dimensions of the panels. Typically, the outside dimensions of the container is substantially the same as the inside dimensions of the container. However, it may be advantageous to reduce an inside length dimension, e.g., to keep items placed in the container from moving around inside the container. If one wishes to reduce an inside dimension relative to its corresponding outside dimension, a separate dunnage component is typically placed inside the container.

The dunnage component provides a spacer thereby reducing the inside dimension relative to its corresponding outside dimension. The dunnage component may be affixed to various surfaces inside the container by means of glue, staples, or other suitable means. Alternatively, the dunnage component may be held inside the container by mere friction or the dunnage component may comprise tabs extending into holes or grooves formed along the inside surfaces of the container.

One disadvantage of current container designs is that a separate dunnage component needs to be employed when reducing the inside dimension of a container. Such a separate dunnage component must be manufactured separately from the one piece flat blank. Consequently, the dunnage component must be inventoried and placed within a container after the container has been erected. Also, it is costly to manufacture and later install such a separate component.

BRIEF SUMMARY OF THE INVENTION

In accordance with the general object of the present invention, a container is provided having a reduced inside length dimension relative to its corresponding outside length dimension when the container is in an erect condition.

It is another object of the present invention to provide a reduced inside dimension using an integrally formed spacer.

These objects of the present invention are achieved by providing a container having a reduced inside length dimension relative to its corresponding outside length dimension when the container is in an erect condition.

In a preferred embodiment, the container includes a plurality of panels defining a bottom and opposing first and second sidewall panels. The sidewall panels are foldably joined to the bottom panel. A first end flap is foldably joined to an end of the first sidewall panel and is foldable to form an integral spacer when the container is in an erect condition to thereby provide for the reduced inside length dimension of the container.

In accordance with another aspect of the present invention, a container is provided with a bottom and opposing first and second sidewalls extending upward from the bottom. An end wall is formed of complementary first and second end wall flaps extending inward from the first and second sidewalls, respectively. Each of the end wall flaps form a respective inner panel spaced from a respective outer panel defining a gap therebetween.

A feature of the present invention relates to the use of an integral spacer which provides for a reduced inside length dimension of a container relative to an outside length dimension.

An additional feature of the present invention, in one form thereof, concerns the use of an end flap foldably joined to a sidewall panel which provides an integral spacer in the form of an inner panel spaced from an outer panel defining a gap therebetween.

Further features and advantages of the present invention will be set forth in, or apparent from, the detailed description of preferred embodiments thereof which follows.

BRIEF DESCRIPTION OF THE DRAWING

The invention will now be described in detail with respect to preferred embodiments with reference to the accompanying drawings, wherein.

DETAILED DESCRIPTION OF THE INVENTION

Figure 1:
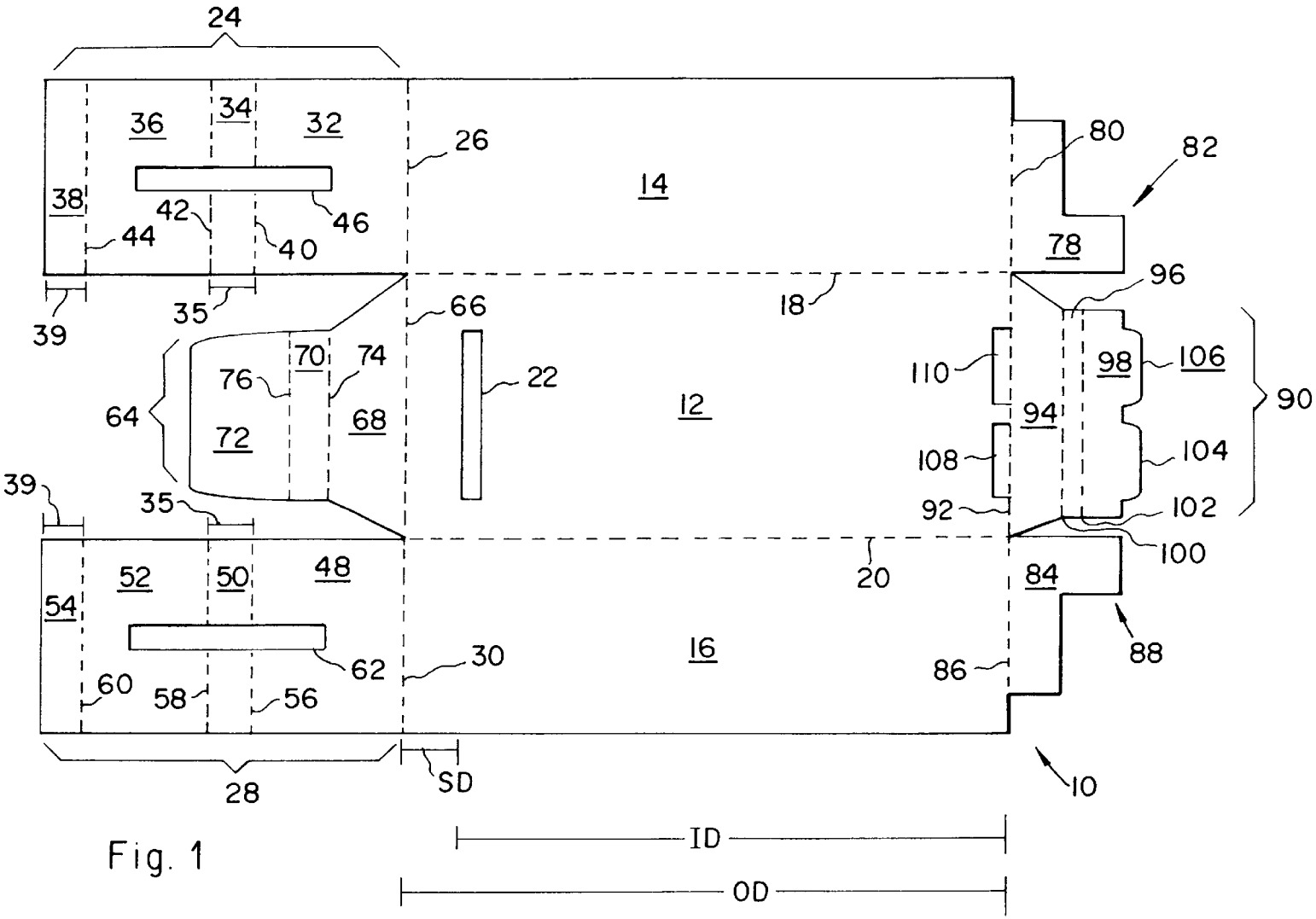
FIG. 1 is a plan view of a blank from which the erect container of the present invention is formed.

Referring now to the drawings, like numbers represent like elements throughout the several views. Reference numeral 10 generally identifies a collapsed, storage and transport condition in FIG. 1 and in an erect condition in FIGS. 2 and 3. The container 10 includes a bottom panel 12, a first sidewall panel 14 and a second sidewall panel 16, all of these walls being generally planar. The first sidewall panel 14 is foldably connected to the bottom panel 12 along fold line 18. The second sidewall panel 16 is foldably joined to the bottom panel 12 along fold line 20. A bottom panel aperture 22 is formed through the bottom panel 12. In the erect condition, the first sidewall panel 14 and the second sidewall panel 16 fold along the folding lines 18, 20, to form two opposing sidewall panels.

The first end flap 24 is foldably joined to the first sidewall panel 14 along folding line 26. A second end flap 28 is foldably joined to the second sidewall panel 16 along fold line 30. The first end flap 24 includes a plurality of panels defined by a plurality of fold lines. Specifically, an outer panel 32, an intervening panel 34, an inner panel 36, and an end panel 38 are foldably joined along the length of the first end flap 24 along fold lines 40, 42, and 44 respectively. A first end flap aperture 46 is formed through the first end flap 24.

The second end flap 28 comprises an outer panel 48, an intervening panel 50, an inner panel 52 and an end panel 54 foldably joined along folding lines 56, 58 and 60, respectively. A second end flap aperture 62 is formed through the second end flap 28.

Center flap 64 is foldably joined to the bottom panel 12 along fold line 66. Center flap 64 includes an outer panel 68, an intervening panel 70 and an inner panel 72 foldably joined along fold lines 74 and 76 respectively.

End flap 78 is foldably attached to the first sidewall panel 14 along fold line 80 and includes portion 82. End of flap 84 is foldably attached to the second sidewall panel 16 along fold line 86 and includes an end flap portion 88. Center flap 90 is foldably attached to the bottom panel 12 along fold line 92. Center panel 90 includes an outer wall portion 94, an intervening wall panel 96 and an inner wall portion 98 foldably joined along fold lines 100 and 102. Tabs 104, 106 extend from the inner wall portion 98 and are adapted to lockingly engage with bottom panel apertures 108, 110 respectively.

Figure 2:
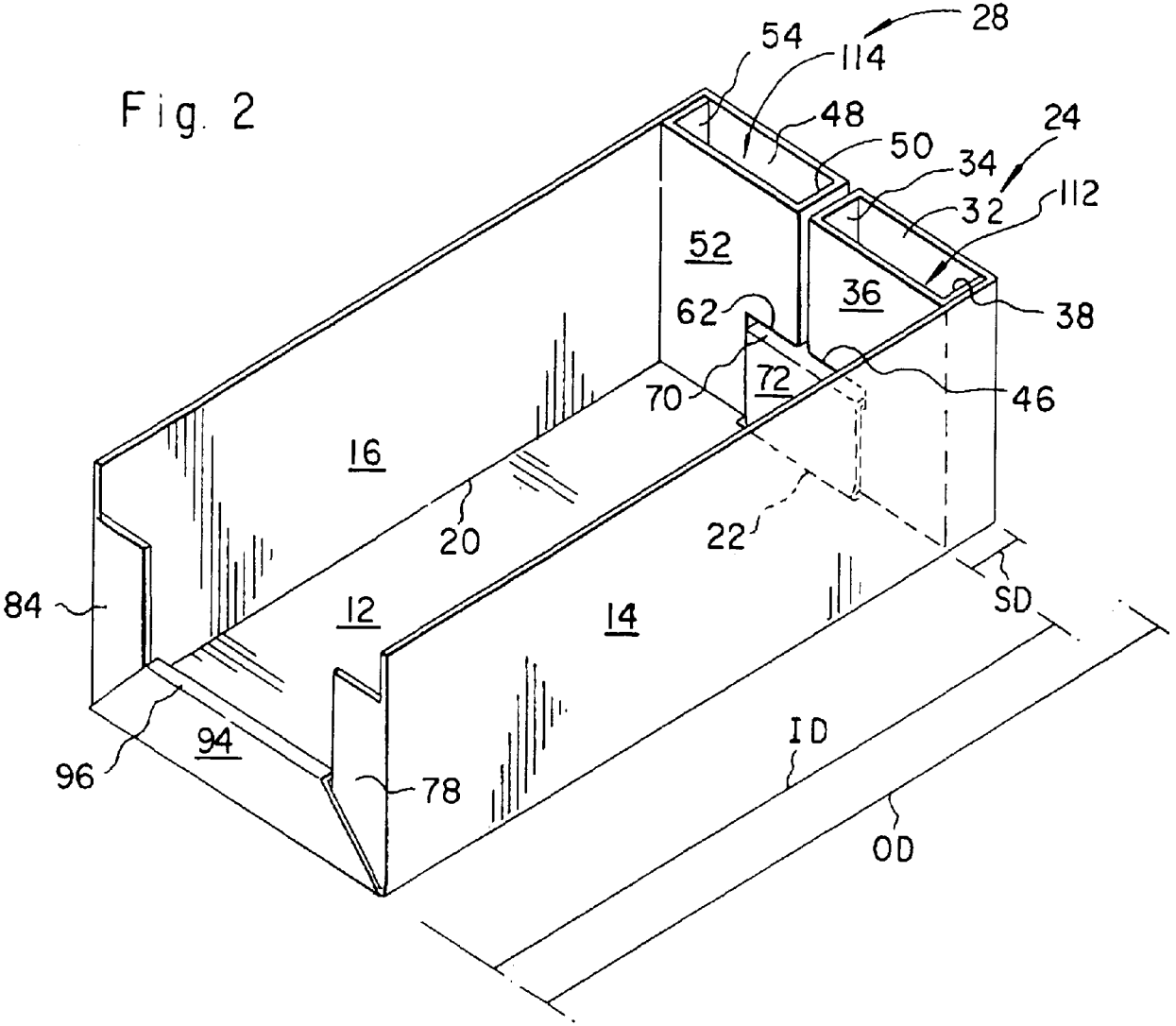
FIG. 2 is a perspective view from one end of the container formed from the blank of FIG. 1.
Figure 3:
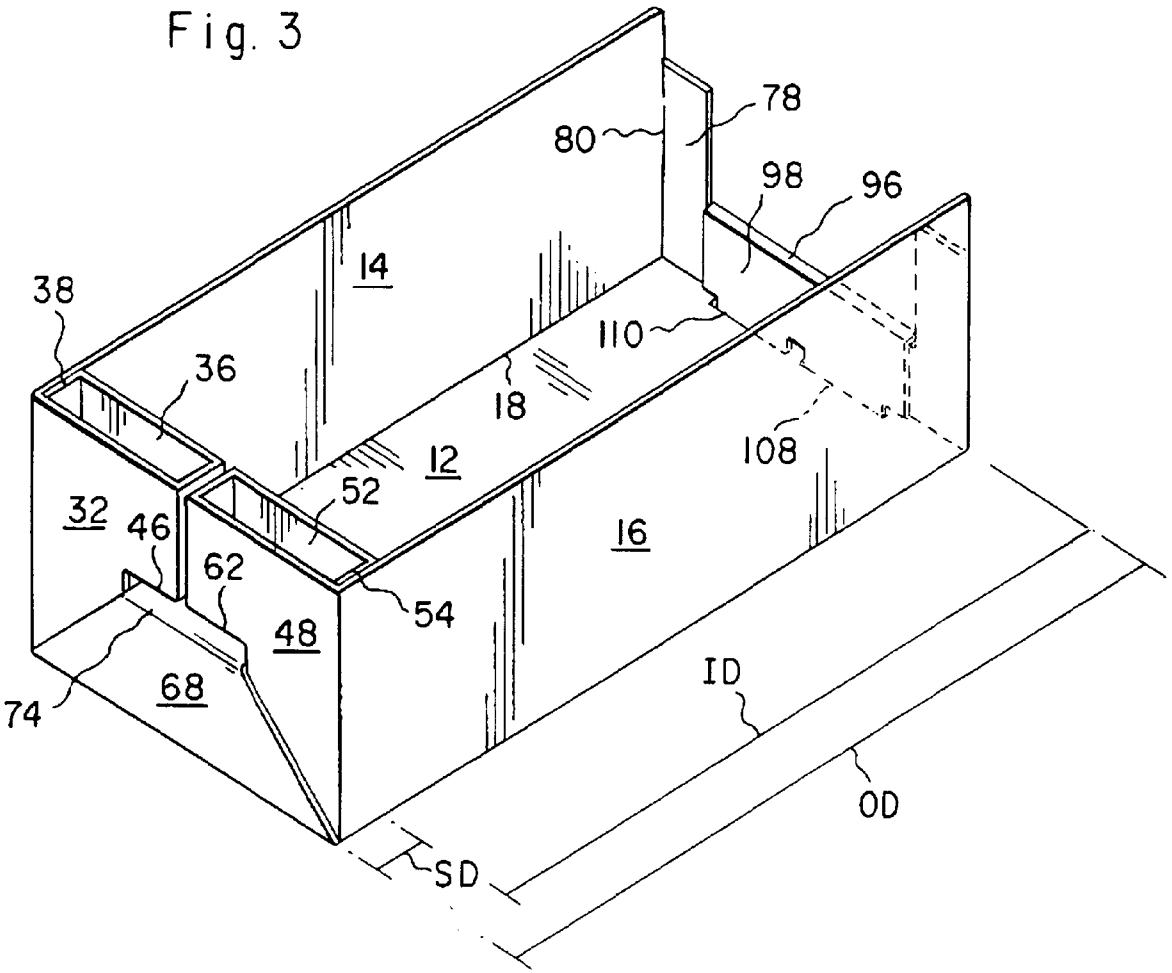
FIG. 3 is a perspective view similar to FIG. 2 but from the other end.

In the erect condition, the first end flap 24 is folded along the fold lines 26, 40, 42, and 44 to form one half of one end of the container 10 (FIGS. 2(*a*) and 2(*b*)). The second end flap 28 is folded along fold lines 30, 56, 58, and 60 to enclose the other half of the end of the container 10. Center flap 64 folds along fold lines 60, 74, and 76. The inner panel 72 is inserted through the first end flap aperture 46 and the second end flap aperture 62 and lockingly engages in bottom aperture 22.

In the erect condition, the first sidewall panel 14 and the second sidewall panel 16 form a pair of opposing sidewalls substantially coplanar with each other and perpendicular to the bottom panel 12. The first end flap 24 and the second end flap 28 extend inward from the first sidewall panel 14 and second sidewall panel 16, respectively, and are folded along their respective fold lines to provide the inner panels 36, 52 to be spaced from the outer panels 32, 48, and to define gaps 112, 114 therebetween, respectively. Together, the end flaps 24, 28 form an integral spacer that reduces an inside length dimension (indicated by line ID) relative to an outer dimension (indicated by line OD) of the container 10.

When the first sidewall panel 14 is coplanar with the second sidewall panel 16, the end flaps 78, 84 are folded along fold lines 80, 86 inward towards each other. Center flap 90 is folded over the end flap portions 82, 88 by folding along fold lines 100, 102. Tabs 104, 106 are subsequently lockingly engaged in bottom panel apertures 108, 110, respectively.

The widths 35 of intervening panels 34, 50 and the widths 39 of end panels 38, 54 define the width of the integral spacer (indicated as a spacer dimension by line SD). Thus, the gap provided between the outer walls 24, 28 and the inner walls 36, 52 is defined by the width 35 of intervening panels 34, 50 and the width 39 of the end panels 38, 54.

It will be apparent to one of ordinary skill in the art that any desired inside length dimension can be formed by providing end flaps 24, 28 with intervening panels 34, 50 and end panels 38, 54 of appropriate widths. As a result, the present invention provides for an infinite range of inside length dimensions relative to a corresponding outside dimension with the use of a series of panels extending from the sidewall panels which are folded along folding lines to form an integral spacer of a spacer dimension to provide the desired reduced inside length dimension.

Although the invention has been described in detail with respect to preferred embodiments thereof, it will be apparent to one skilled in the art that the invention is capable of numerous modifications and variations, within the spirit and scope of the invention.

What is claimed is:

1. A container having a reduced inside length dimension relative to its corresponding outside length dimension, said container comprising:

a plurality of panels defining a bottom and a first sidewall panel opposite a second sidewall panel, said sidewall panels foldably joined to said bottom panel, said bottom having a bottom aperture;

a first end flap foldably joined to an end of said first sidewall panel, said first end flap having a first end flap aperture and foldable to form an integral spacer defining a gap between portions of said end flap to thereby provide for the reduced inside length dimension of the container;

a second end flap foldably joined to an end of said second sidewall panel, said second end flap foldable to form an integral spacer whereby said second end flap with said first end flap provides the reduced inside length dimension of the container; and a center flap foldably joined to said bottom panel on one end and having an opposing end adapted to fit into said first end flap aperture and to lockingly engage with said bottom panel aperture.

2. The container of claim 1, wherein said end flap comprises a second end flap aperture and said opposing end of said center flap adapted to fit into said second end flap aperture.

3. The container of claim 1, wherein said first end flap and said second end flap each comprise an inner panel, an intervening panel, an outer panel, and an end panel, said intervening panel foldably disposed between said inner panel and said outer panel, and said end panel foldably attached to said inner end panel, said intervening panel and said end panel having a respective panel width defining a width of said integral spacer.

4. The container of claim 1, wherein said first end flap comprises an inner panel, an intervening panel, an outer panel, and an end panel, said intervening panel foldable disposed between said inner panel and said outer panel, and said end panel foldable attached to said inner end panel, said intervening panel and said end panel having a respective panel width defining a width of said integral spacer.

5. A container comprising:

a bottom having a bottom panel aperture;

opposing first and second sidewalls extending upward from said bottom;

an end wall formed of complementary first and second end wall flaps extending inward from said first and second sidewalls, respectively, each said end wall flap forming a respective inner panel spaced from a respective outer panel defining a gap therebetween, said first end wall flap having a first end wall aperture, said second end wall flap having a second end wall flap aperture; and a center flap extending upward from said bottom and securing with said first end wall flap and said second end wall flap, said center flap having an end opposite said bottom adapted to fit through said first end wall flap aperture and said second end wall flap aperture and lockingly engages with said bottom panel aperture.

6. The container of claim 5, wherein each end wall aperture traverses the respective inner panel and outer panel.

7. The container of claim 5, wherein said first end wall flap and said second end wall flap each further comprise a respective intervening panel foldable disposed between the respective inner panel and the respective outer panel and a respective end panel foldable attached to the respective inner end panel, said intervening panels and said end panels having a respective panel width defining a gap width of said gap.

8. A container having a reduced inside length dimension relative to its corresponding outside length dimension, said container comprising:

a plurality of panels defining a bottom panel and a first sidewall panel opposite a second sidewall panel, said first and second sidewall panels foldably joined to said bottom panel;

a first end flap foldably joined to an end of said first sidewall panel; and a second end flap foldably joined to an end of said second sidewall panel, a center flap foldably joined to said bottom panel and having a height less than the height of said first and second end flaps, whereby said first end flap and second end flap foldable to form an integral spacer spanning across an interior width dimension of the container, said first end flap and said second end flap foldable to define a gap between portions of said first end flap and said second end flap, respectively, to thereby provide for the reduced inside length dimension of the container.

9. The container of claim 8, wherein said first end flap and said second end flap each comprise an end panel aperture, and said center flap foldably joined to said bottom panel on one end and having an opposing end adapted to fit into said end flap apertures.

10. The container of claim 9, wherein said opposing end of said center flap lockingly engages with a bottom panel aperture.

11. The container of claim 8, wherein said first end flap and said second end flap each comprise an inner panel, an intervening panel, an outer panel, and an end panel, said intervening panel foldably disposed between said inner panel and said outer panel, and said end panel foldably attached to said inner end panel, said intervening panel and said end panel having a respective panel width defining a width of said integral spacer.

12. The container of claim 8, wherein said first end flap comprises a first end panel aperture and said center flap foldably joined to said bottom panel on one end and having an opposing end adapted to fit into said first end flap aperture.

13. The container of claim wherein said opposing end of said center flap lockingly engages with a bottom panel aperture.

* * * * *